US009303913B2

(12) United States Patent
Ha

(10) Patent No.: US 9,303,913 B2
(45) Date of Patent: Apr. 5, 2016

(54) REFRIGERATOR

(75) Inventor: Kyungho Ha, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 403 days.

(21) Appl. No.: 13/825,056

(22) PCT Filed: Aug. 29, 2011

(86) PCT No.: PCT/KR2011/006372
§ 371 (c)(1),
(2), (4) Date: Mar. 19, 2013

(87) PCT Pub. No.: WO2012/039553
PCT Pub. Date: Mar. 29, 2012

(65) Prior Publication Data

US 2013/0174598 A1 Jul. 11, 2013

(30) Foreign Application Priority Data

Sep. 20, 2010 (KR) ..... 10-2010-0092296

(51) Int. Cl.
*F25D 23/06* (2006.01)
*F25D 11/00* (2006.01)
*F25D 17/06* (2006.01)

(52) U.S. Cl.
CPC ..... *F25D 11/00* (2013.01); *F25D 17/065* (2013.01); *F25D 23/068* (2013.01); *F25C 2400/10* (2013.01); *F25D 2317/062* (2013.01); *F25D 2317/067* (2013.01)

(58) Field of Classification Search
CPC ... F25D 23/068; F25D 23/065; F25D 23/062; F25D 2317/061; F25D 2317/067; F25D 23/064
See application file for complete search history.

(56) References Cited

U.S. PATENT DOCUMENTS

| | | | | |
|---|---|---|---|---|
| 5,996,370 | A * | 12/1999 | Lee | 62/407 |
| 2005/0076669 | A1* | 4/2005 | Jenkins et al. | 62/407 |
| 2007/0074527 | A1* | 4/2007 | Lee et al. | 62/344 |
| 2009/0255291 | A1 | 10/2009 | Lee et al. | |
| 2010/0147009 | A1 | 6/2010 | Kim et al. | |

FOREIGN PATENT DOCUMENTS

| | | | |
|---|---|---|---|
| JP | 10-103844 | A | 4/1998 |
| JP | 03599919 | B2 | 12/2004 |

OTHER PUBLICATIONS

PCT International Search Report dated Apr. 13, 2012 for Application No. PCT/KR2011/006372, 3 pages.

* cited by examiner

*Primary Examiner* — Cassey D Bauer
(74) *Attorney, Agent, or Firm* — Fish & Richardson P.C.

(57) ABSTRACT

Provided is a refrigerator. The refrigerator includes a cabinet defining a storage space, a heat exchange chamber defined in a side of the cabinet to receive an evaporator, an ice making compartment defined in at least one region of the storage space to define an insulation space for making ices; and a cool air duct connecting the heat exchange chamber to the ice making compartment to provide a passage for guiding a flow of cool air. The cool air duct includes a cover part defining inner and outer appearance of the cool air duct and an insulation part formed of an insulation material, the insulation part being disposed inside the cover part.

5 Claims, 5 Drawing Sheets

REFRIGERATOR

CROSS REFERENCE TO RELATED APPLICATIONS

This application is a U.S. National Phase Application under 35 U.S.C. §371 of International Application PCT/KR2011/006372, filed on Aug. 29, 2011, which claims the benefit of Korean Application No 10-2010-0092296, filed on Sep. 20, 2010, the entire contents of which are hereby incorporated by reference in their entireties.

TECHNICAL FIELD

Embodiments relate to a refrigerator.

BACKGROUND ART

Generally, a refrigerator is a home appliance, which stores foods in a storage space that is covered by a door to keep foods at low temperatures. The refrigerator enables foods to be stored in a fresh state by cooling the inside of the storage space using cold air generated through heat exchange with refrigerant that circulates through a cooling cycle.

The inside of the refrigerator may be divided into a refrigerator compartment and a freezer compartment. Receiving members such as shelves, drawers, and baskets are disposed within the refrigerator compartment and the freezer compartment. The refrigerator compartment and freezer compartment are covered by doors. The refrigerator is classified into various types according to positions of the refrigerator compartment and the freezer compartment and configurations of the doors.

The size of the refrigerator tends to increase more and more and multi-functions are provided to the refrigerator as dietary life changes and pursues high quality, and accordingly, refrigerators of various structures with consideration of user convenience are brought to the market.

For example, the refrigerator may include an ice making device for making ices. The refrigerator may further include a dispenser for dispensing the made ices to the outside thereof. The ice making device may be disposed in a freezer compartment or a freezer compartment door. Also, the ice making device may be disposed in a refrigerator compartment or a refrigerator compartment door, which have an insulation space.

DISCLOSURE OF INVENTION

Technical Problem

Embodiments provide a refrigerator in which a cool air duct for supplying cool air into an ice making compartment has superior thermal performance.

Solution to Problem

In one embodiment, a refrigerator includes: a cabinet defining a storage space; a heat exchange chamber defined in a side of the cabinet to receive an evaporator; an ice making compartment defined in at least one region of the storage space to define an insulation space for making ices; and a cool air duct connecting the heat exchange chamber to the ice making compartment to provide a passage for guiding a flow of cool air, wherein the cool air duct includes: a cover part defining inner and outer appearance of the cool air duct; and an insulation part formed of an insulation material, the insulation part being disposed inside the cover part.

The cover part may be formed of polyethylene (PE) or polyvinyl chloride (PVC).

The insulation part may be manufactured by filling and foaming the insulation material inside the cover part.

The cover part may surround an inner surface and outer surface of the insulation part.

The cabinet may include an outer case defining an outer appearance, an inner case defining the storage space, and an insulation material filled between the inner case and the outer case, and the cool air duct may be disposed between the outer case and the inner case.

The refrigerator may further include a support part protruding outward from the cover part, wherein the support part contacts the outer case or the inner case to allow at least one portion of the cool air duct to be spaced from the outer case or the inner case.

A passage part recessed inward from the cover part to define the passage may be defined in the cover part.

A plurality of outlets and inlets connected to the passage part to allow cool air to take in/out through the passage part may be defined in the cover part.

The passage part may be continuously provided in plurality in a horizontal direction.

The passage may include: a supply passage supplying cool air for making ices into the ice making compartment; and a recovery passage discharging the cool air into the heat exchange chamber or the storage space.

The supply passage and the recovery passage may be partitioned into a plurality of spaces along a flow direction of the cool air.

The cool air duct may be manufactured by coupling a first duct member and a second duct member, which are disposed on both left and right sides of the cool air duct, and the first and second duct members may be manufactured by the cover part and the insulation part.

A passage part recessed to define the passage when the first and second duct members are coupled to each other may be disposed in the cover part.

The passage part may be provided in plurality to partition the inside of the passage into a plurality of spaces.

A portion of the plurality of passage parts may define a supply passage for guiding a flow of cool air between the heat exchange chamber and the ice making compartment, and the other portion of the plurality of passage parts may define a recovery passage to communicate with the ice making compartment and the freezer compartment.

Advantageous Effects of Invention

According to the proposed embodiment, the cool air duct may be formed of an insulation material having superior thermal performance and the inside and outside of the cool air duct may be independently surrounded by the cover part.

Thus, the thermal performance of the cool air duct in which the cool air flows may be improved to prevent the inside of the refrigerator compartment from having an influence the temperature variation even though the cool air duct is disposed adjacent to the refrigerator compartment. Also, the loss of the cool air may be prevented to improve power consumption.

When the cool air duct is formed of the insulation material, gases may be generated before and after the insulation material is formed. However, since the insulation part may be surrounded by the cover, it may prevent the gases generated by the insulation material from being mixed with the cool air.

Thus, it may prevent the inside of the refrigerator and the foods within the refrigerator from being contaminated by the gases generated in the insulation material.

MODE FOR THE INVENTION

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
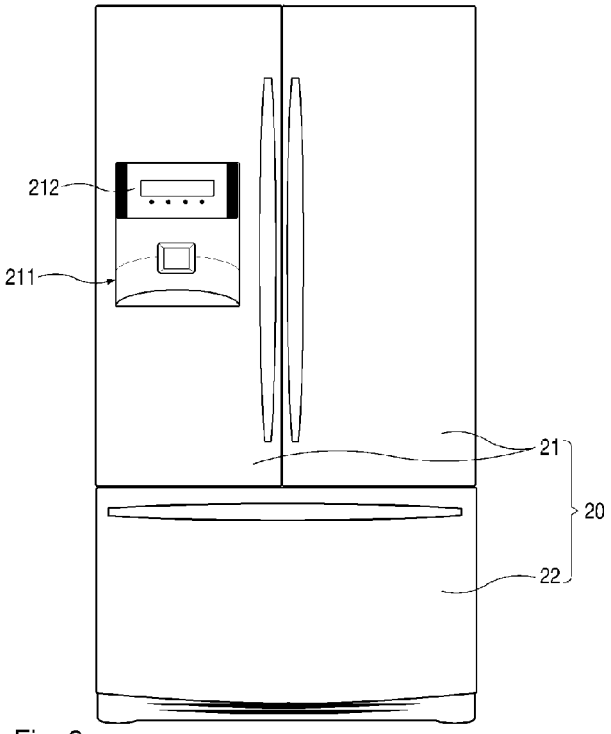
FIG. 1 is a front view of a refrigerator according to an embodiment.
Figure 2:
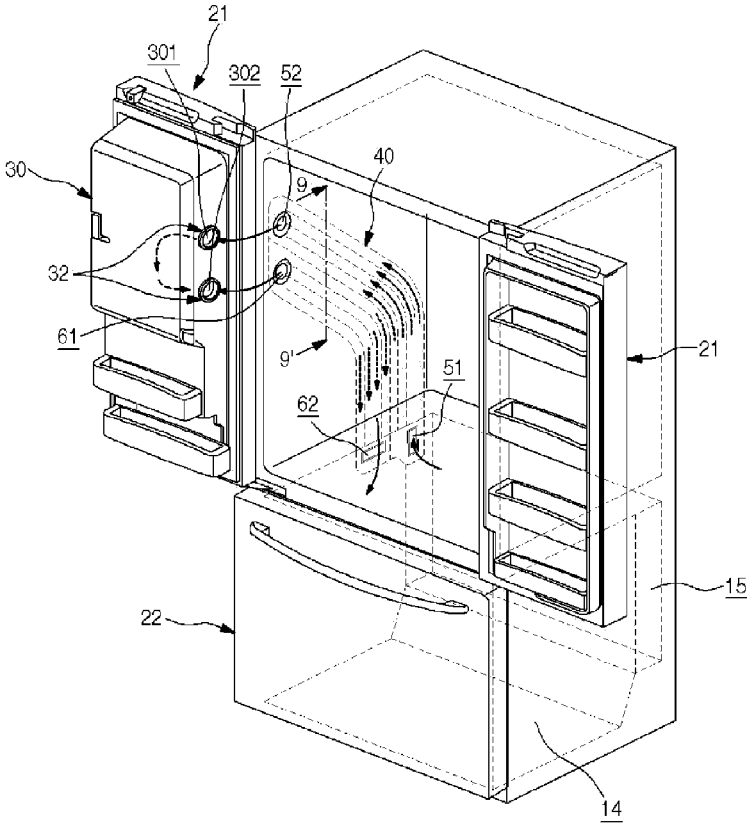
FIG. 2 is a view of a refrigerator door with a refrigerator compartment door opened according to an embodiment.
Figure 3:
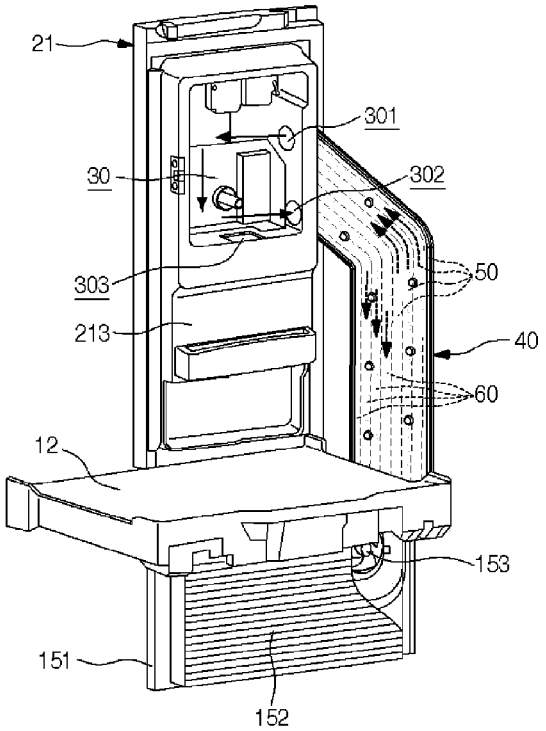
FIG. 3 is a view illustrating a flow of cool air within a cool air duct according to an embodiment.
Figure 4:
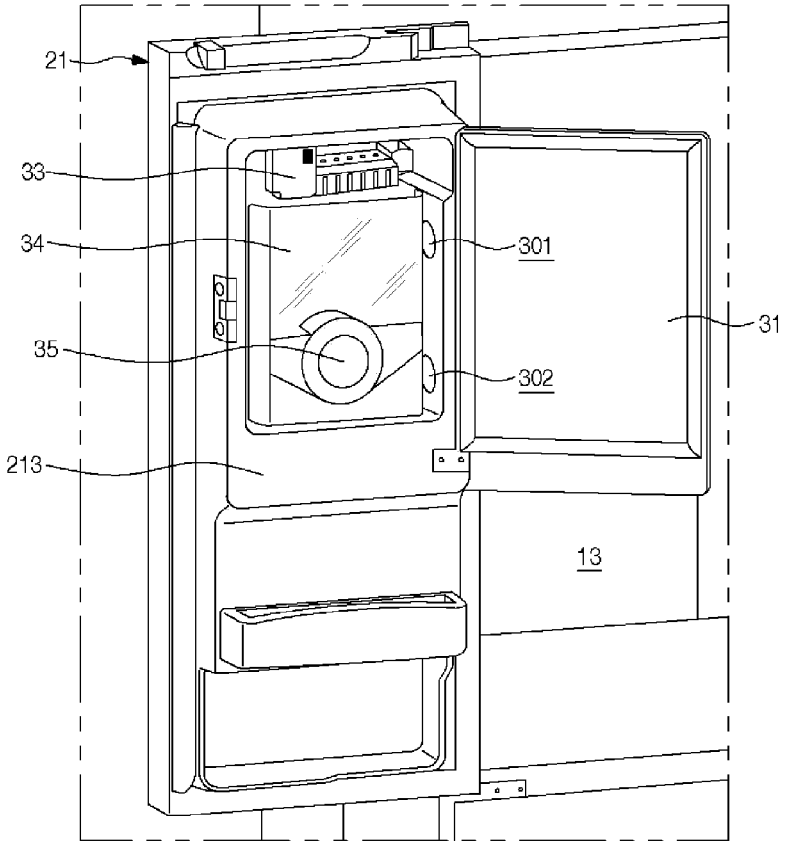
FIG. 4 is a perspective view of a refrigerator compartment door with an ice making compartment opened according to an embodiment.

FIG. 1 is a front view of a refrigerator according to an embodiment. FIG. 2 is a view of a refrigerator door with a refrigerator compartment door opened according to an embodiment. FIG. 3 is a view illustrating a flow of cool air within a cool air duct according to an embodiment. FIG. 4 is a perspective view of a refrigerator compartment door with an ice making compartment opened according to an embodiment.

Referring to FIGS. 1 and 4, a refrigerator 1 includes a cabinet 10 defining a storage space therein and a door 20 opening/closing the storage space. Here, an outer appearance of the refrigerator 1 is defined by the cabinet 10 and the door 20.

The cabinet 10 may have on opened front side. The cabinet 10 includes an outer case 101 defining an outer appearance thereof and an inner case 102 coupled to the outer case 101 to define the storage space within the outer case 101. The outer case and the inner case 102 may be spaced from each other. An insulation material 103 is disposed between the outer case 101 and the inner case 102. Here, the insulation material 103 may be manufactured by injecting a foaming agent between the outer case 101 and the inner case 102. Thus, the storage space within the refrigerator 1 may be thermally insulated from the outside of the refrigerator 1 to maintain a low temperature state.

The storage space may be vertically partitioned by a barrier 12 to define a refrigerator compartment 13 at an upper side and a freezer compartment 14 at a lower side. A plurality of receiving members for receiving foods may be disposed inside the refrigerator compartment 13 and the freezer compartment 14.

A heat exchange chamber 15 is defined in a rear side of the freezer compartment 14. The heat exchange chamber 15 is configured to receive an evaporator 152 that is one component of a refrigeration cycle. The heat exchange chamber 15 is partitioned from the freezer compartment 14 by a grill fan 151.

Also, the heat exchange chamber 15 may be directly or indirectly connected to the freezer compartment 14, the refrigerator compartment 13, and an ice making compartment 30 to supply cool air generated in the evaporator 152 into each compartment. At least one blow fan 153 may be disposed in the heat exchange chamber 15 to circulate the cool air into the refrigerator compartment 13, the freezer compartment 14, and the ice making compartment 30.

The door 20 opens and closes the refrigerator compartment 13 and the freezer compartment 14. The door 20 includes a refrigerator compartment door 21 and a freezer compartment door 22.

The refrigerator compartment door 21 opens and closes the refrigerator compartment 13. Also, the refrigerator compartment door 21 includes a pair of left and right doors 20. The refrigerator compartment door 21 is rotatably disposed on the cabinet 10. Also, the left and right doors may be individually opened of closed.

The freezer compartment door 22 opens and closes the freezer compartment 14. Also, the freezer compartment door 22 may be provided in a drawer type to slidably take in/out in front and rear directions. A basket for receiving foods may be disposed on a back surface of the freezer compartment door 22 to take in/out together with the freezer compartment door 22.

A dispenser 211 may be disposed on the refrigerator compartment door 21. The dispenser 211 may dispense purified water or ices to the outside of the refrigerator compartment door 21 and be disposed on a front surface of the door 20.

The dispenser 211 may be disposed on a side of the pair of refrigerator compartment doors 21. Also, the dispenser 211 may communicate with the ice making compartment 30 that will be described below in detail. A display 212 for displaying and adjusting an overall operation state of the dispenser 211 and the refrigerator 1 may be further disposed on the dispenser 211.

The ice making compartment 30 is defined in the back surface of the refrigerator compartment door 21 including the dispenser 211. The ice making compartment 30 provides a space in which ices are made. The ice making compartment 30 is defined as an openable/closable insulation space in the back surface of the refrigerator compartment door 21.

In detail, the ice making compartment 30 may be recessed backward from the back surface of the refrigerator compartment door 21 to define a predetermined space. Thus, the insulation material 103 may be filled around the ice making compartment 30 to insulate the inside of the ice making compartment 30 from the outside. Also, a door liner 213 defining a back surface of an ice making compartment door 31 may be recessed backward to define the ice making compartment 30. Thus, the ice making compartment 300 is opened toward a front side. Also, the ice making compartment door 31 is rotatably disposed on the ice making compartment 30 to open or close the ice making compartment 30.

Thus, the ice making compartment 30 may define an independent space in a state where the ice making compartment door 31 is closed. Also, a thermally insulated space may be defined inside the ice making compartment 30 in a sate where the refrigerator compartment door 21 is closed.

An ice making compartment cool air inlet 301 and an ice making compartment cool air outlet 302 which communicate with a cool air duct 40 that will be described below are disposed in one surface of the ice making compartment 30 when the refrigerator compartment door 21 is closed. The ice making compartment cool air inlet 301 and the ice making compartment cool air outlet 302 may be disposed in a sidewall of the ice making compartment 30. Also, the ice making compartment cool air inlet 301 and the ice making compartment cool air outlet 302 may be vertically spaced from each other.

The ice making compartment cool air inlet 301 and the ice making compartment cool air outlet 302 may be a cool air outlet and inlet of the ice making compartment 30, respectively. Thus, cool air introduced into the ice making compartment cool air inlet 301 is recovered through the ice making compartment cool air outlet 302 via the inside of the ice making compartment 30.

An ice making compartment gasket 32 is disposed on an outer surface of the ice making compartment 30. The ice making compartment gasket 32 may be disposed around each of the ice making compartment cool air inlet 301 and the ice making compartment cool air outlet 302. Thus, the ice making compartment gasket 32 may be closely attached to an inner wall of the refrigerator compartment 13 when the refrigerator compartment door 21 is closed to prevent cool air flowing into/from a cool air duct 40 that will be described below from leaking.

An ice outlet 303 opened downward is disposed in a bottom surface of the ice making compartment 30. The ice outlet 303 is an outlet for providing ices stored in the ice making compartment 30 into the dispenser 211. The ice outlet 303 may be connected to the dispenser 211 and an ice chute to dispense ices when the dispenser 211 is operated.

An ice maker 33 and an ice bank 34 may be disposed inside the ice making compartment 30. The ice maker 33 receives supplied water to make ices. The ice maker 33 may be disposed above the ice making compartment 30. The water may be automatically supplied into the ice maker 33. When the ices are completely made within the ice maker 33, the ices may be automatically transferred.

The ice bank 34 in which the ices are stored is disposed under the ice maker 33. The ice bank 34 stores the ices made in the ice maker 33. Also, the ice bank 34 communicates with the ice outlet 303. An auger 35 rotated to prevent the stored ices from cling to each other may be disposed within the ice maker 33. A blade for selectively dispensing the ices dispensed through the ice outlet into an ice piece state may be further disposed within the ice bank 34.

The cool air duct 40 is disposed in the cabinet 10. The cool air duct 40 is configured to guide the cool air generated in the evaporator into the ice making compartment 30 and is configured to recover the cool air within the ice making compartment 30 into the freezer compartment 14 or the heat exchange chamber 15.

The cool air duct 40 is disposed inside the cabinet 10 adjacent to the refrigerator compartment door 21 having the ice making compartment 30. Also, the cool air duct 40 is disposed between the outer case 101 and the inner case 102 which define the cabinet 10. Thus, the cool air duct 40 may be fixed by the insulation material filled between the outer case 101 and the inner case 102.

Also, lower ends of the cool air duct 40 are disposed in the freezer compartment 14 and the heat exchange chamber 15 in which the evaporator is disposed, respectively. The cool air duct 40 may extend up to a height of the refrigerator compartment 13 corresponding to that of the ice making compartment 30.

After the cool air duct 40 is mounted, when the refrigerator compartment door 21 is closed, the inner walls of the refrigerator compartment 13 corresponding to the ice making compartment cool air inlet 301 and the ice making compartment cool air outlet 302 are opened in a shape corresponding to each other. The openings may be disposed at positions and with sizes corresponding to those of a supply passage outlet 52 and a recovery passage inlet 61 which are disposed in upper end of the cool air duct 40. Thus, cool air may flow between the cool air duct 40 and the ice making compartment 30. A grill 40 may be disposed in the opened portion to prevent foreign materials from being introduced into the cool air duct 40.

Also, the wall of the heat exchange chamber 15 corresponding to the supply passage inlet 51 and the recovery passage outlet 62 disposed in the lower end of the cool air duct 40 and the wall of the freezer compartment may be opened to communicate with the supply passage inlet 51 and the recovery passage outlet 62. Thus, the cool air may flow between the freezer compartment 14, the heat exchange chamber 15, and the cool air duct.

Hereinafter, the cool air duct will be described in more detail with reference to the accompanying drawings.

Figure 5:
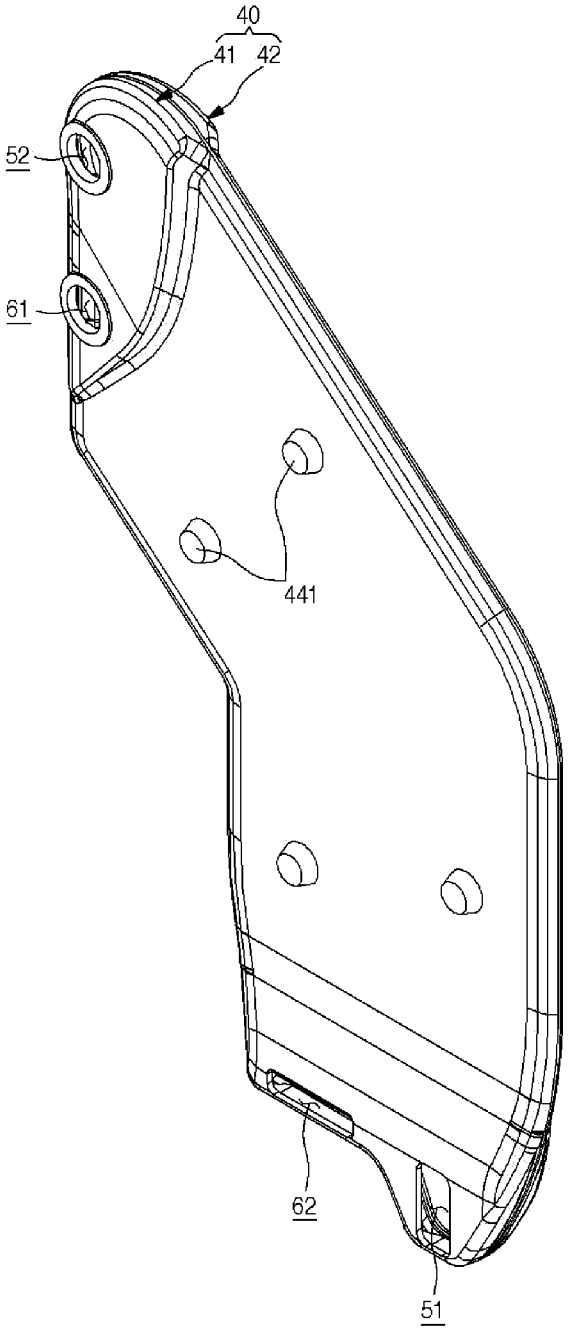
FIG. 5 is a perspective view of a cool air duct according to an embodiment.
Figure 6:
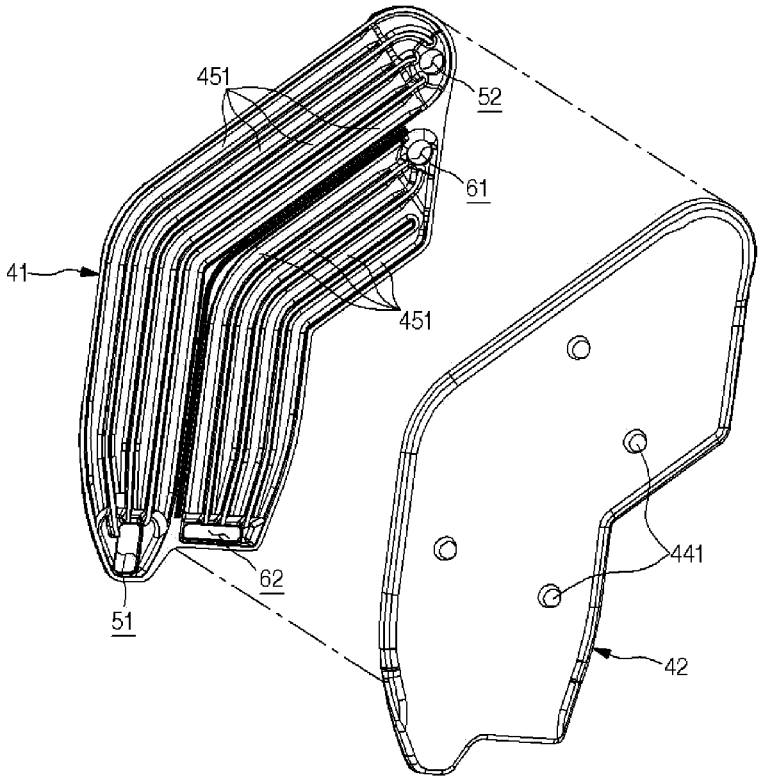
FIGS. 6 and 7 are exploded perspective views of the cool air duct.
Figure 7:
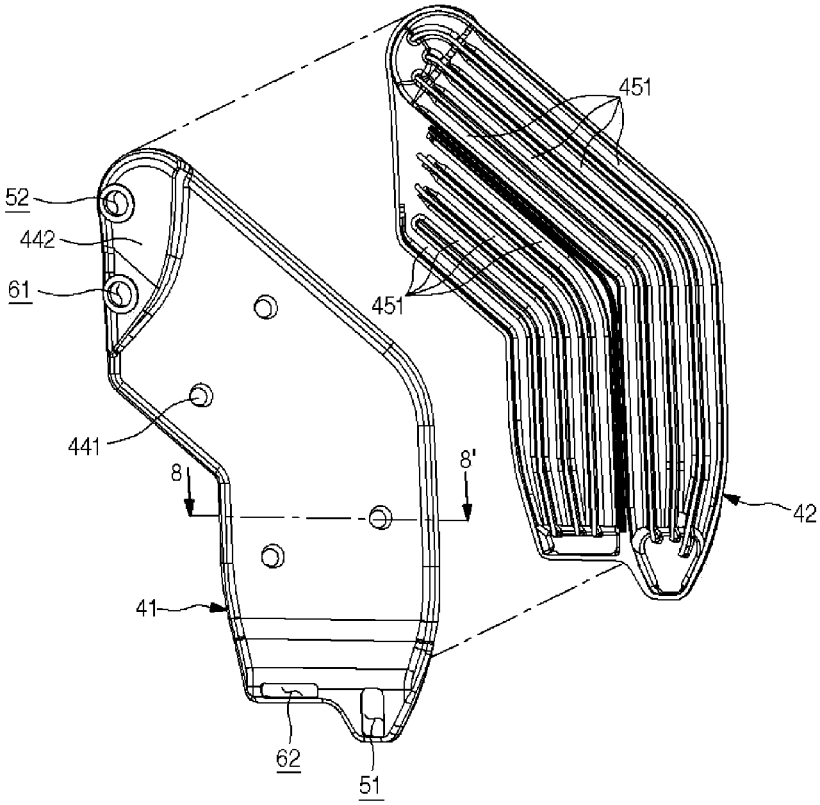
Figure 8:
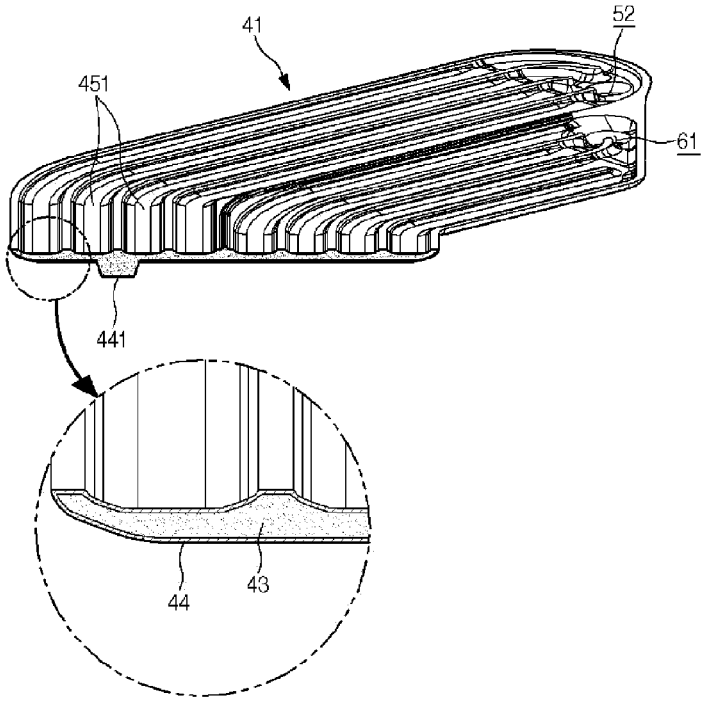
FIG. 8 is a partially sectional perspective view taken along line 8-8' of FIG. 7.
Figure 9:
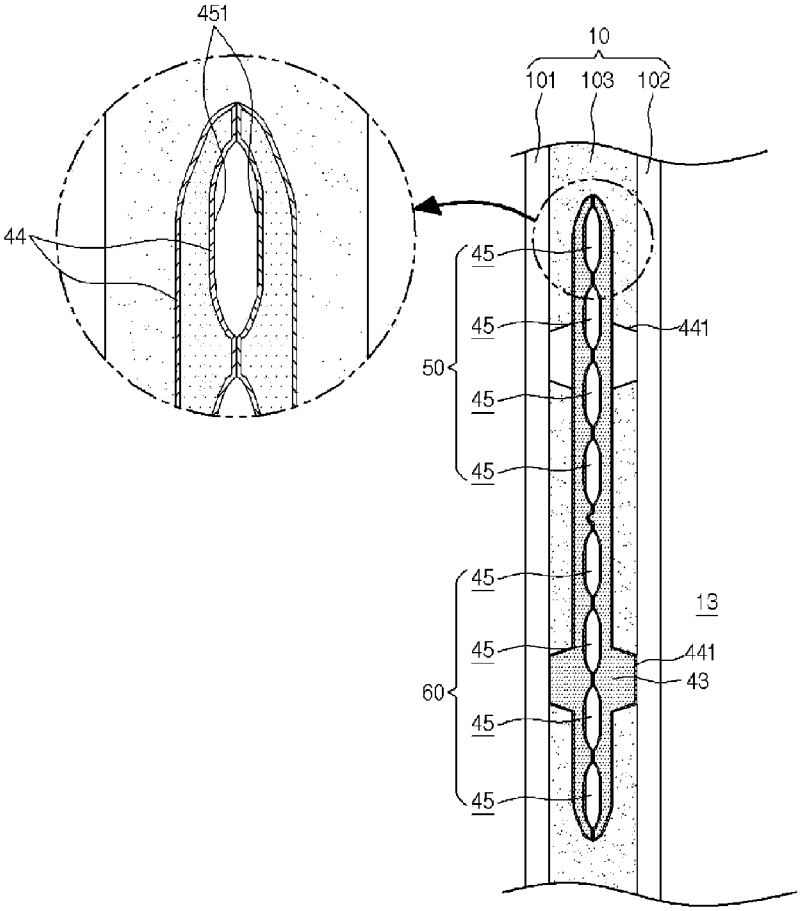
FIG. 9 is a sectional view taken along line 9-9' of FIG. 2.

FIG. 5 is a perspective view of a cool air duct according to an embodiment. FIGS. 6 and 7 are exploded perspective views of the cool air duct. Fig. is a partially sectional perspective view taken along line 8-8' of FIG. 7. FIG. 9 is a sectional view taken along line 9-9' of FIG. 2.

Referring to FIGS. 5 to 9, a first duct member 41 and a second duct member 42 are coupled to each other to manufacture the cool air duct 40. The cool air duct 40 is formed of an insulation material. A passage 45 providing a path through which the cool air flows is defined in the cool air duct 40. A plastic material may surround an outer surface and an inner surface of the cool air duct 40 to define an outer appearance of the cool air duct 40.

In detail, the cool air duct 40 includes the first duct member 41 and the second duct member 42 at both left and right sides with respect to a thickness direction of the cool air duct 40, respectively. The first and second duct members 41 and 42 may be coupled to the whole appearances of the passage 45 and the cool air duct 40.

Each of the first and second duct members 41 and 42 may include an insulation part 43 defining the outside thereof and a cover part 44 disposed on the outer surface of the insulation part to define an outer appearance thereof.

The insulation part 43 may be formed of a polyurethane (PU) having superior thermal performance. The insulation part 43 may have thermal performance greater than that of the insulation material 103 formed of expended polystyrene (EPS) and filled between the outer case 101 and the inner case 102. The insulation part 43 may have a shape corresponding to each of those of the first and second duct members 41 and 42.

The insulation part 43 may have a shape corresponding to that of a passage part 451 disposed in the cover part 44, the supply passage inlet and outlet 51 and 52, and the recovery passage inlet 61 and 62 to allow the cover part 44 to surround the insulation part 43. Thus, the first and second duct members 41 and 42 may be smoothly formed.

The cover part 44 may be formed of a synthetic resin material to surround the insulation part 43. In detail, the cover part 44 may be formed of polyethylene (PE) or polyvinyl chloride (PVC).

The cover part 44 may surround the cool air duct 40, i.e., the outsides of the first and second duct members 41 and 42. Thus, the cover part 44 may define the outer appearances of the first and second duct members 41 and 42. Also, the insulation part 43 may completely fill an inner space defined by the cover part 44 to maintain the thermal performance of the cool air duct 40.

Also, the cover part 44 may completely cover the first and second duct members 41 and 42 to prevent the insulation part 43 from being exposed to the outside and the passage 45. Thus, when or after the insulation part 43 formed of a polyurethane material is foamed, it should prevent harmful gases generated in the polyurethane from leaking to the outside.

To form the cool air duct 40, the first and second duct members 41 and 42 may be separately formed. Each of the first and second duct members 41 and 42 may include the insulation part 43 and the cover part 44.

In detail, for forming the first and second duct members 41 and 42, the cover part 44 having a sheet shape with a predetermined thickness is disposed on each of upper and lower jigs. Then, the polyurethane material for forming the insulation part 43 may be injected between the jigs disposed on the cover part 44 to foam the polyurethane material. Thus, the insulation part 43 may be filled inside the cover part 44. The gases generated when the insulation part 43 is formed may be blocked by the cover part 44. As described above, the cover part 44 may surround an outer surface of the cool air duct 40 and an inner surface of the passage 45.

Alternatively, the insulation part 43 and the cover part 44 may be separately formed and then the insulation part 43 may be fitted into the cover part 44 to manufacture the first and second duct members 41 and 42. Also, in the first duct member 41 and the second duct member 42, coating or wrapping may be performed around the insulation part 43 to form the cover part 44. Thus, the insulation part 43 is surrounded by the cover part 44.

Also, after the first and second duct members 41 and 42 are completely formed, the first and second duct members 41 and 42 are coupled to each other. Here, surrounding surfaces of the first and second duct members 41 and 42 may contact each other. Also, the portions contacting each other and the surroundings of the first and second duct members 41 and 42 may adhere to each other or be fused with each other in one body. Also, the first and second duct members 41 and 42 may be coupled to each other to form the passage 45 within the cool air duct 40.

A plurality of passage parts 451 may be disposed in the cover part 45. The passage parts 451 may be provided for forming the passage 45. The passage parts 451 are disposed in the first and second duct members 41 and 42, respectively. When the first and second duct members 41 and 42 are coupled to each other, the passage parts 451 may adhere to contact each other to form the passage 45. Thus, the passage part 451 may have the same shape as those of the first and second duct members 41 and 42 and be disposed on position corresponding to each other.

Each of the passage parts 451 may be recessed within the cover part 44. Also, the recessed sectional surface of the cover part 44 may be rounded. Thus, when the first and second duct members 41 and 42 are coupled to each other, the passage 45 may have a circular or oval shape in section. When the passage part 451 has a rounded shape, the insulation part 43 filled inside the cover part 44 may be closely attached to a bottom surface of the passage part 451. Also, since the passage part 451 does not have an edge portion, the insulation part 43 and the cover part 44 may be closely attached to each other.

The passage parts 451 may be disposed longitudinally in a length direction of the cool air duct 40. Also, the plurality of passage parts 451 may be laterally spaced a predetermined distance from each other. A portion of the plurality of passage parts 451 may be connected to the supply passage inlet 51 and the supply passage outlet 52 which will be described below in detail to form a supply passage 50. Also, the other portion of the plurality of passage parts 451 may be connected to the recovery passage inlet 61 and the recovery passage outlet 62 which will be described below in detail to form a recovery passage 60.

The supply passage inlet and outlet 51 and 52 and the recovery passage inlet and outlet 61 and 62 may be defined in a side of one of the first and second duct members 41 and 42. The supply passage inlet and outlet 51 and 52 and the recovery passage inlet and outlet 61 and 62 may be disposed on a side of the first and second duct members 41 and 42. Hereinafter, as shown in FIG. 6, a structure in which the supply passage inlet and outlet 51 and 52 and the recovery passage inlet and outlet 61 and 62 is disposed on the first duct member 41 will be described as example.

The supply passage outlet 52 and the recovery passage inlet 61 may be disposed in an upper portion of the first duct member 41. The supply passage outlet 52 and the recovery passage inlet 61 may be connected to the openings defined in the inner wall of the refrigerator compartment 13. Also, the supply passage outlet 52 and the recovery passage inlet 61 may be disposed on positions corresponding to those of the ice making compartment cool air inlet 301 and the ice making compartment cool air outlet 302. Thus, when the refrigerator compartment door 21 is closed, the cool air may be connected to each other to flow between the ice making compartment 30 and the cool air duct 40.

The supply passage inlet 51 and the recovery passage outlet 62 may be disposed in a lower portion of the first duct member 41. The supply passage inlet 51 may communicate with the heat exchange chamber 15, and the recovery passage outlet 62 may communicate with the freezer compartment 14. Thus, the cool air cooled by the evaporator 152 may be introduced into the supply passage inlet 51 and supplied into the ice making compartment 30. Air heat-exchanged in the ice making compartment may be discharged into the recovery passage outlet and introduced into the freezer compartment 14 to perform the circulation of the cool air. As necessary, the supply passage inlet 51 and the recovery passage outlet 62 may communicate with the heat exchange chamber 15 and be connected to the freezer compartment 14.

The supply passage inlet 51 may be longitudinally disposed in a vertical direction. This is done for a reason to secure a flow amount of the cool air within the heat exchange chamber 15 having a narrow width. Thus, the supply passage inlet 51 may be vertically disposed with a long length greater than that of the recovery passage outlet 62. On the other hand, the recovery passage outlet 62 connected to the freezer compartment 14 and having a relatively small spatial limitation may be longitudinally disposed in a horizontal direction. Although the supply passage inlet 51 and the recovery passage outlet 62 have shapes different from each other, the supply passage inlet 51 and the recovery passage outlet 62 may have the same area as each other. Thus, the cool air may flow uniformly.

The supply passage 50 may be defined by the plurality of passages 45 to connect the supply passage inlet 51 to the supply passage outlet 52. Also, the recovery passage 60 may be defined by the remaining passages 45 to connect the recovery passage inlet 61 to the recovery passage outlet 62. The supply passage 50 and the recovery passage 60 may form the same number of the passage 45. The number of passages 45 constituting the supply passage 50 and the number of passage 45 constituting the recovery passage 60 may be different from each other so that a flow amount supplied into the ice making compartment 30 and a flow amount recovered from the ice making compartment 30 are different from each other. Alternatively, the passage 45 may have sectional areas different from each other so that a flow amount supplied into the ice making compartment 30 and a flow amount recovered from the ice making compartment 30 are different from each other.

Also, a central portion of the cool air duct 40 may be bent. This is done because the number of passages 45 defined in the cool air duct 40 is large. Also, this is done because the cool air duct 40 has a large width on the whole due to the internal insulation part 43. Thus, a central portion of the cool air duct 40 may be bent to guide the cool air. Also, upper and lower ends of the plurality of passages 45 may be disposed toward the supply passage inlet 51, the supply passage outlet 52, the recovery passage inlet 61, and the recovery passage outlet 62, respectively.

A support part 441 may be disposed on outer surfaces of both left and right sides of the cool air duct 40, i.e., an outer surface of the cover part 44. The support part 441 may protrude outward to contact the inner surface of each of the outer case 101 and the inner case 102. Thus, as shown in FIG. 9, the cool air duct 40 may be fixed to maintain a predetermined distance from the outer case 101 and the inner case 102 within the outer case 101 and the inner case 102.

Specifically, the support part 441 should be disposed on the first duct member 41. Also, the support member 441 disposed on the first duct member 41 may contact the inner surface of the inner case 102 to allow the cool air duct 40 to be spaced a height of the support part 441 from the inner case 102. Thus, the insulation material 103 may be filled between the cool air duct 40 and the inner case 102. Accordingly, the cool air within the cool air duct 40 does not have an influence on the inside of the refrigerator compartment 13.

Also, a protrusion 442 may be disposed on the first duct member 41. The protrusion 442 may protrude by a height corresponding to that of the support part 441. Also, each of the supply passage outlet 52 and the recovery passage inlet 61 may be defined in the protrusion 442 to allow the supply passage outlet 52 and the recovery passage inlet 61 to be closely attached to the inner case 102.

Although not shown, a heating member may be disposed around the supply passage inlet 51, the supply passage outlet 52, the recovery passage inlet 61, and the recovery passage outlet 62. The heating member may prevent occurrence of frost and implantation during the circulation of the cool air. The heating member may be disposed on a side of the cool air duct 40 or the inner case 102.

Hereinafter, operations of a refrigerator configured as described above will be described.

When the refrigerator compartment door 21 is closed, the ice making compartment cool air inlet 301 and the ice making compartment cool air outlet 302 may communicate with the cool air duct 40 to allow the cool air to flow therebetween. Also, in a state where the refrigerator compartment door 21 is closed, the ice making compartment gasket 32 may contact a circumference of the opening defined in the refrigerator compartment 13 to prevent the cool air from leaking to the outside. Thus, the ice making compartment 30 and the cool air duct 40 may communicate with each other to allow the cool air to flow therebetween.

In this state, the cool air may be supplied to make ices in the ice maker 33 or prevent ices stored in the ice bank 34 from thawing out. For this, the cool air generated in the evaporator 152 within the heat exchange chamber 15 may be forcedly blown by the blow fan 153 and supplied into the refrigerator compartment 13, the freezer compartment 14, and the ice making compartment 30.

The cool air within the heat exchange chamber 15 may be introduced into the supply passage 50 through the supply passage inlet 51 of the cool air duct 40. Also, the cool air flowing along the supply passage 50 may pass through the supply passage outlet 52 and the ice making compartment cool air inlet 301 in order and then be supplied into the ice making compartment 30.

Here, the sufficient amount of cool air passing through the supply passage inlet 51 longitudinally defined in a vertical direction may be supplied into the ice maker 33 through the ice making compartment cool air inlet 301 without being lost.

The cool air within the ice making compartment 30 may pass through the ice making compartment cool air outlet 302 under the ice making compartment cool air inlet 301 and the recovery passage inlet 61 in order and then be introduced into the cool air duct 40. Also, the cool air introduced into the cool air duct 40 may flow along the recovery passage 60 and be discharged into the freezer compartment 14 through the recovery passage outlet 62.

Here, the sufficient amount of cool air passing through the supply passage inlet 51 and the recovery passage outlet 62 which are longitudinally defined in a vertical direction may be discharged from the ice making compartment into the ice making compartment 30 without being lost. Also, the cool air within the freezer compartment 14 may be introduced into the heat exchange chamber 15 and then cooled again.

As described above, when the cool air is circulated into the heat exchange chamber 15, the ice making compartment 30, and the freezer compartment 14 through the cool air duct 40, the inside of the ice making compartment 30 may be maintained at a temperature for making ices and maintaining the ice-made state.

Also, in the state where ices are made and stored in the ice making compartment 30, the ices within ice making compartment 30 may be dispensed through the dispenser 211 by manipulation of a user.

In the circulation process of the cool air through the cool air duct 40, the cool air may pass through the refrigerator compartment 13. However, the cool air duct 40 is surrounded by the insulation material 103 disposed between the outer case 101 and the inner case 102. Specifically, the passage 45 may be defined inside the insulation part 43 constituting the cool air duct 40 to prevent the cool air within the cool air duct 40 from having an influence on a temperature variation of the inside of the refrigerator compartment 13. In addition, the heat loss of the cool air may be minimized also.

INDUSTRIAL APPLICABILITY

According to the embodiment, the thermal performance of the cool air duct may be improved to prevent the cool air from leaking and also prevent the inside of the refrigerator from being contaminated by the gases generated by the insulation material. Therefore industrial applicability is high.

The invention claimed is:

1. A refrigerator comprising:

a cabinet defining a storage space;

a heat exchange chamber defined in a side of the cabinet and configured to receive an evaporator;

an ice making compartment defined in a region of the storage space and configured to define an insulation space for making ice; and a cool air duct configured to connect the heat exchange chamber to the ice making compartment and provide a passage for guiding a flow of cool air between the heat exchange chamber and the ice making compartment, wherein the cool air duct comprises:

a first duct member that defines a first side of the cool air duct;

a second duct member that defines a second side of the cool air duct, the second side of the cool air duct being opposite of the first side of the cool air duct;

a plurality of cool air supply passages defined inside the cool air duct;

a plurality of cool air return passages defined inside the cool air duct, the plurality of cool air return passages being isolated from the plurality of cool air supply passages; and an insulation part that includes an insulation material, wherein the first duct member includes:

a first cover part including:

a first outer surface part defining an outer surface of the first side of the cool air duct; and a first inner surface part defining an opposite surface of the first outer surface part;

wherein the second duct member includes:

a second cover part including:

a second outer surface part defining an outer surface of the second side of the cool air duct; and a second inner surface part defining an opposite surface of the second outer surface part;

wherein the insulation part is disposed between and inside of the first cover part and the second cover part, wherein the first inner surface part of the first cover part includes:

a first plurality of recess parts; and a first plurality of protrusion parts which are alternately arranged with the first plurality of recess parts, wherein the second inner surface part of the second cover part includes:

a second plurality of recess parts; and a second plurality of protrusion parts which are alternately arranged with the second plurality of recess parts, wherein the first plurality of recess parts of the first duct member face the second plurality of recess parts of the second duct member to establish the plurality of cool air supply and return passages defined inside the cool air duct, and wherein the first plurality of protrusion parts of the first duct member contact the second plurality of protrusion parts of the second duct member to partition the plurality of cool air supply and return passages from each other.

2. The refrigerator of claim 1, wherein one of the first and second duct members includes:

a supply passage inlet for supplying the cool air in the heat exchange chamber to the plurality of cool air supply passages in the cool air duct;

a supply passage outlet for discharging the cool air flowing along the plurality of cool air supply passages;

a return passage inlet for returning the cool air in the ice making compartment to the plurality of cool air return passages in the cool air duct; and a return passage outlet for discharging the cool air along the plurality of cool air return passages.

3. The refrigerator of claim 2, wherein the supply passage inlet and the return passage outlet are formed at a first end of the one of the first and second duct members, and wherein the supply passage outlet and the return passage inlet are formed at a second end of the one of the first and second duct member.

4. The refrigerator of claim 1, wherein the cabinet comprises:

an outer case defining an outer appearance of the refrigerator;

an inner case coupled to an inside of the outer case and defining the storage space; and an insulation material filled in a space between the inner case and the outer case, wherein the cool air duct is disposed in the space between the outer case and the inner case.

5. The refrigerator of claim 4, further comprising:

one or more first support parts protruding from the first outer surface part of the first cover part of the first duct member; and one or more second support parts protruding from the second outer surface part of the second cover part of the second duct member, wherein the one or more first support parts and the one or more second support parts contact at least one of the outer case and the inner case to allow the cool air duct to be spaced from the outer case and the inner case.

* * * * *